US008878046B2

(12) United States Patent
Nakagawa et al.

(10) Patent No.: US 8,878,046 B2
(45) Date of Patent: Nov. 4, 2014

(54) ADJUSTING A LEVEL AT WHICH TO GENERATE A NEW TONE WITH A CURRENT GENERATED TONE

(75) Inventors: Mizuki Nakagawa, Hamamatsu (JP); Shun Takai, Hamamatsu (JP)

(73) Assignee: Roland Corporation, Hamamatsu (JP)

( * ) Notice: Subject to any disclaimer, the term of this patent is extended or adjusted under 35 U.S.C. 154(b) by 171 days.

(21) Appl. No.: 13/408,769

(22) Filed: Feb. 29, 2012

(65) Prior Publication Data

US 2012/0247307 A1 Oct. 4, 2012

(30) Foreign Application Priority Data

Mar. 29, 2011 (JP) ..... 2011-073437

(51) Int. Cl.
*G10H 1/46* (2006.01)

(52) U.S. Cl.
CPC ..... *G10H 1/46* (2013.01)
USPC ..... 84/634; 84/633; 84/711

(58) Field of Classification Search
USPC ..... 84/634
See application file for complete search history.

(56) References Cited

U.S. PATENT DOCUMENTS

| | | | | |
|---|---|---|---|---|
| 5,179,240 | A * | 1/1993 | Mizuno et al. | 84/613 |
| 6,362,410 | B1 * | 3/2002 | Kira | 84/618 |
| 2003/0005815 | A1 | 1/2003 | Bruti et al. | |

FOREIGN PATENT DOCUMENTS

| | | |
|---|---|---|
| EP | 1752966 | 2/2007 |
| JP | 2002366145 | 12/2002 |

OTHER PUBLICATIONS

English machine translation of JP2002366145 published Dec. 20, 2002.

* cited by examiner

*Primary Examiner* — Christopher Uhlir
(74) *Attorney, Agent, or Firm* — David W. Victor; Konrad Raynes Davda & Victor LLP

(57) ABSTRACT

Provided are a tone control device and a method for adjusting a volume level at which to generate a new tone and at least one current tone according to a target volume level and a current volume level. A note-on event associated with a received volume level is received from an input device. A current volume level is processed to determine a new volume level in response to receiving the note-on event while generating at least one current tone at the current volume level. The at least one current tone and a new tone associated with the received note-on event are generated at the new volume level.

25 Claims, 5 Drawing Sheets

ADJUSTING A LEVEL AT WHICH TO GENERATE A NEW TONE WITH A CURRENT GENERATED TONE

CROSS-REFERENCE TO RELATED FOREIGN APPLICATION

This application is a non-provisional application that claims priority benefits under Title 35, United States Code, Section 119(a)-(d) from Japanese Patent Application entitled "TONE CONTROL DEVICE" by Mizuki NAKAGAWA and Shun TAKAI, having Japanese Patent Application Serial No. 2011-073437, filed on Mar. 29, 2011, which Japanese Patent Application is incorporated herein by reference in its entirety.

BACKGROUND OF THE INVENTION

1. Field of the Invention

Provided are a tone control device and a method for adjusting a level at which to generate a new tone with a current generated tone.

2. Description of the Related Art

A musical instrument having a bellows, such as, an accordion and a bandoneon, controls its volume according to movements of the bellows. Japanese Patent Application No. 2002-366145, also published as U.S. Patent Application No. 2003/005815, describes an electronic accordion that imitates an acoustic accordion. The electronic accordion detects a pressure inside a bellows. A sound source composed of an electronic circuit is controlled so as to generate a tone with a pitch and a volume according to the pressure detected and the keyboard operated.

Electronic musical instruments such as synthesizers and the like can generate tones with various kinds of tone colors. When performance of a natural musical instrument is imitated by an electronic musical instrument, it is necessary to make the tone colors to be faithfully imitated to tone colors of the natural musical instrument. In addition, the performer needs to understand characteristics peculiar to the musical instrument and need to perform while operating user interfaces of the musical instrument (such as, for example, the keyboard, the pitch-bend lever, the modulation lever, the HOLD pedal and the like) during his or her performance. Therefore, when the performer attempts to imitate performance of a certain musical instrument, using an electronic musical instrument, the performer needs to have good understanding of the characteristics of the musical instrument to be imitated, and is required to have high-level skills in performance technique to make full use of the user interfaces according to the characteristics during performance.

To imitate performance of an accordion or the like using an electronic musical instrument such as a synthesizer without a bellows, instead of using an electronic accordion or a similar electronic musical instrument, the performer needs to make full use of the user interfaces such as an expression pedal, a volume pedal and the like. Therefore, the performer is required to have high-level performance technique, such as, skills in freely controlling the timings to operate the user interfaces.

SUMMARY

Provided are a tone control device and a method for adjusting a volume level at which to generate a new tone and at least one current tone according to a target volume level and a current volume level. A note-on event associated with a received volume level is received from an input device. A current volume level is processed to determine a new volume level in response to receiving the note-on event while generating at least one current tone at the current volume level. The at least one current tone and a new tone associated with the received note-on event are generated at the new volume level.

DETAILED DESCRIPTION

Figure 1:
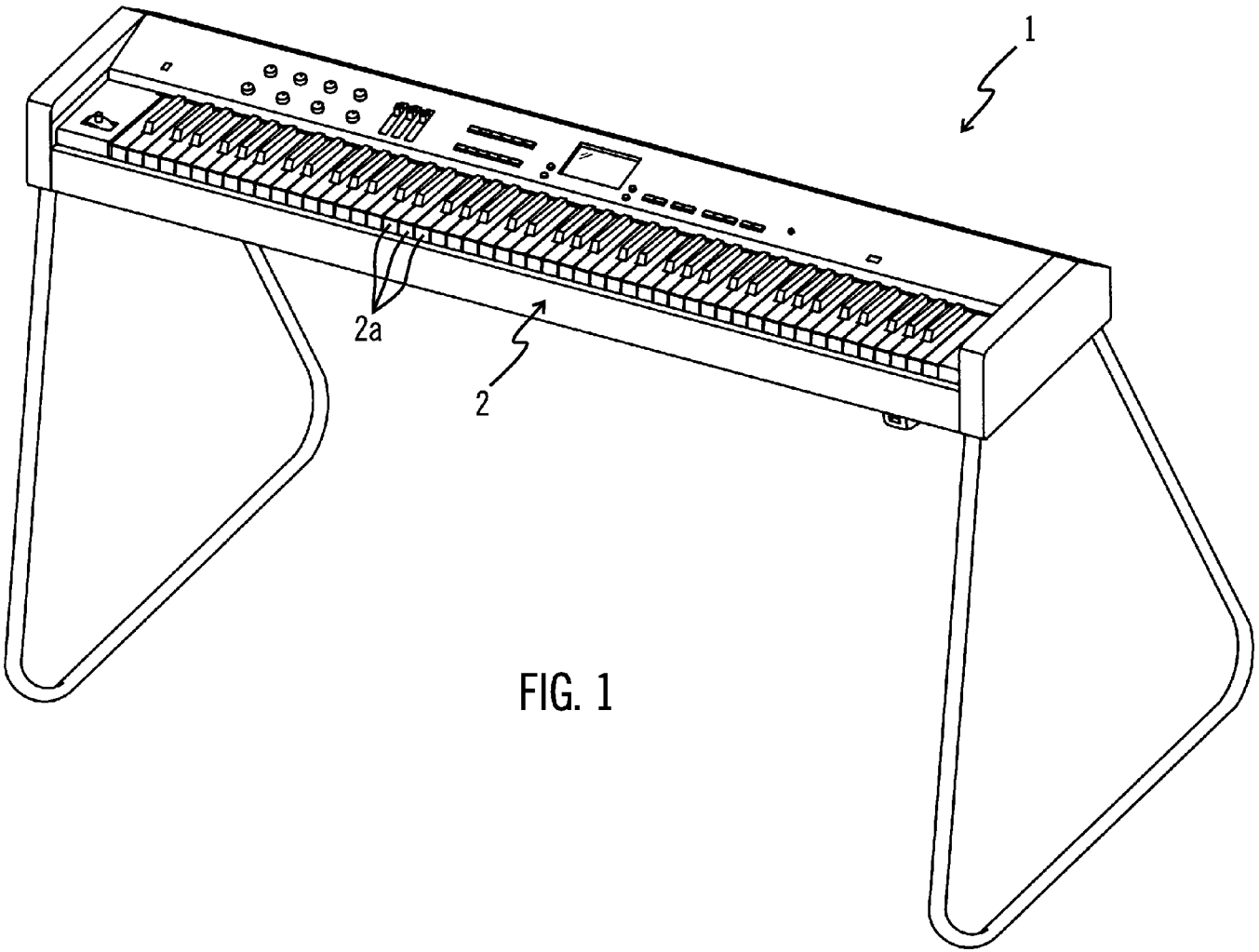
FIG. 1 is an external appearance of an electronic musical instrument provided with a tone control device.

Described embodiments provide a tone control device that can render an electronic musical instrument without having a bellows to sufficiently imitate performance of a musical instrument characteristic to an accordion or the like.

In described embodiments, when a tone generation instruction is inputted by an input device, a target level is set, by a target level setting device, based on a tone level corresponding to volume information included in the tone generation instruction. If a tone that is subject to processing and being generated by a tone generation device is present when the tone generation instruction is inputted from the input device, an instruction device instructs the tone generation device to generate a tone with a pitch corresponding to pitch information included in the tone generation instruction at the same level as the level of the tone that is subject to processing and being generated. Furthermore, the instruction device thereafter instructs the tone generation device to gradually change the level of all tones that are subject to processing and being generated by the tone generation device toward the target level set by the target level setting device. Therefore, both the tone based on the newly inputted tone generation instruction and the tones that are subject to processing and being generated when the new tone generation instruction is inputted gradually change from the level of the tones that are subject to processing and being generated when the tone generation instruction is inputted to the target level set based on the newly inputted tone generation instruction.

In described embodiments, when a new tone generation instruction is inputted while tones are being generated by the tone generation device, the level of tones that are subject to processing and being generated when the new tone generation instruction is inputted can be made to follow the target level set based on the new tone generation instruction. Here, the target level is a level that is set based on the level of a tone corresponding to volume information included in the new tone generation instruction. Therefore, performance of a musical instrument in which the level (volume) of generated tones is controlled according to movements of a bellows (for example, an accordion) can be imitated. In other words, by changing the volume information at each tone generation instruction, performance of a musical instrument in which the level of generated tones is controlled according to movements of a bellows can be imitated, such that performance of an accordion-like musical instrument can be readily imitated.

Tone generation based on the new tone generation instruction is not started with the level of a tone corresponding to volume information included in the new tone generation information, but instead with the same level as the level of the tones that are subject to processing and being generated when the new tone generation instruction is inputted. Then the level is gradually changed toward the target level. In other words, the tone based on the new tone generation instruction and the tones that are subject to processing and being generated when the new tone generation instruction is inputted both gradually change from the same level toward the target level. Therefore, the tone based on the new tone generation instruction and the tones that are subject to processing and being generated would not be generated at different levels. Also, the level of tones that are subject to processing and being generated would not be abruptly changed to the target level. Accordingly, changes in the level according to movements of a bellows can be imitated by the level change described above without causing physical uneasiness.

In described embodiments, performance of an accordion-like musical instrument (i.e., a musical instrument in which the level of tones generated is controlled according to movements of the bellows) can be readily and sufficiently imitated by an electronic musical instrument without having a bellows.

In further embodiments, if there is no tone that is subject to processing and being generated by the tone generation device when a tone generation instruction is inputted from the input device, the instruction device instructs the tone generation device to generate a tone with a pitch corresponding to pitch information included in the tone generation instruction at a target level that is set by the target level setting device. Therefore, in this case, a tone with a pitch corresponding to the pitch information included in the new tone generation information can be generated at the target level that is set based on the level of the tone corresponding to volume information included in the new tone generation instruction. Therefore, even when a new tone generation instruction is independently inputted, a tone based on the new tone generation instruction can be generated at the level according to the volume information, and therefore performance of an accordion-like musical instrument can be readily imitated.

In further embodiments, as the tone control device includes the level setting device, the tone control device can execute an interpolation until the level of a tone generated by the tone generation device reaches the target level.

Embodiments of the invention are described with reference to the accompanying drawings. FIG. 1 is an external appearance of an electronic musical instrument 1 provided with a tone control device in accordance with an embodiment of the invention. As shown in FIG. 1, the electronic musical instrument 1 is an electronic keyboard musical instrument having a keyboard 2 composed of a plurality of keys 2*a*. A performer can play a performance piece by depressing or releasing the keys 2*a* of the keyboard 2 of the electronic musical instrument 1.

The keyboard 2 is one of the user interfaces operated by the performer. The keyboard 2 outputs to a CPU 11 (see FIG. 2) note events that are pieces of performance information according to the MIDI (Musical Instrument Digital Interface) standard in response to key-depression and key-release operations on the keys 2*a* by the performer. More specifically, when the key 2*a* is depressed by the performer, the keyboard 2 outputs to the CPU 11 a note-on event (hereafter referred to as a "note-on") that is a piece of performance information indicating that the key 2*a* is depressed. On the other hand, when the key 2*a* that has been depressed by the performer is released, the keyboard 2 outputs to the CPU 11 a note-off event (hereafter referred to as a "note-off") that is a piece of performance information indicating that the depressed key 2*a* is released.

In one embodiment, the tone control device mounted on the electronic musical instrument 1 is configured such that, when the performer newly depresses the key 2*a* in a state where there is a tone being generated, the volume (level) of the tone being generated is controlled to follow the volume of a tone based on a velocity of the newly depressed key. Details of the tone control device are described below. The electronic musical instrument 1 is provided with a tone control device, such that the performer can readily imitate performance of a musical instrument in which the volume is controlled according to movements of a bellows (for example, an accordion, a bandoneon and the like) without necessity to make full use of the user interfaces such as an expression pedal, a volume pedal and the like.

Figure 2:
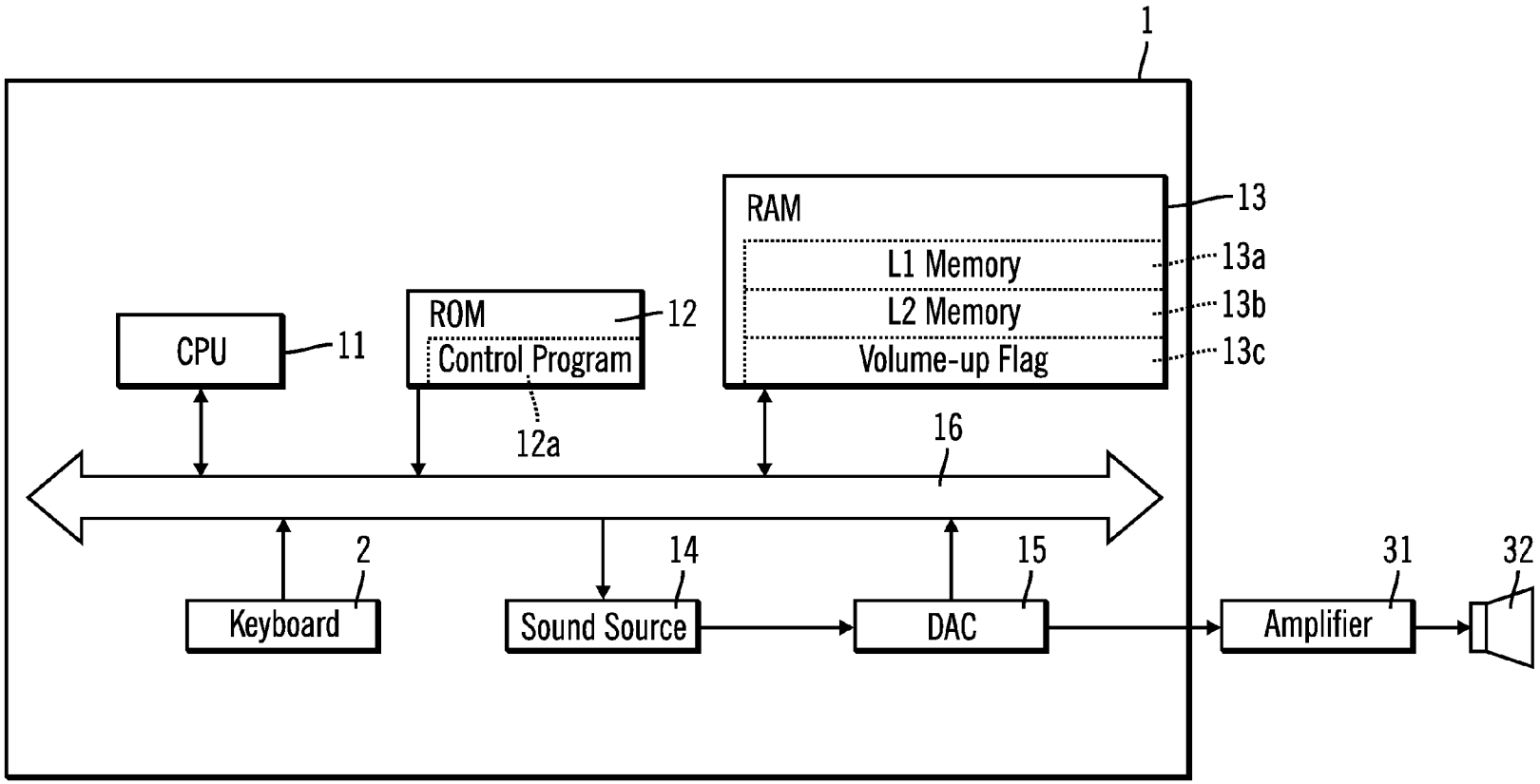
FIG. 2 is a block diagram of an electrical composition of the electronic musical instrument.

FIG. 2 is a block diagram showing an electrical composition of the electronic musical instrument 1. As shown in FIG. 2, the electronic musical instrument 1 includes a CPU 11, a ROM 12, a RAM 13, and a sound source 14; and the components 11-14 and the keyboard 2 are mutually connected through a bus line 16. The tone control device in accordance with the present embodiment may be formed from the CPU 11, the ROM 12 and the RAM 13. The electronic musical instrument 1 also includes a digital-to-analog converter (DAC) 15. The DAC 15 is connected to the sound source 14, and is also connected to an amplifier 31 that is provided outside the electronic musical instrument 1.

The CPU 11 is a central control unit that controls each of the components of the electronic musical instrument 1 according to fixed value data and a control program stored in the ROM 12 and the RAM 13. The CPU 11 includes a built-in timer (not shown) that counts clock signals, thereby measuring the time.

Upon receiving a note-on (a piece of performance information indicating that one of the keys 2*a* is depressed) from the keyboard 2, the CPU 11 outputs a tone generation instruction to the sound source 14, thereby rendering the sound source 14 to start generation of a tone (an audio signal) according to the note-on. Also, upon receiving a note-off (a piece of performance information indicating that one of the keys 2*a* that has been depressed is released) from the keyboard 2, the CPU 11 outputs a silencing instruction to the sound source 14, thereby performing a silencing control. By this, the tone that is being generated by the sound source 14 is stopped.

The ROM 12 is a non-rewritable memory, and stores a control program 12*a* to be executed by the CPU 11, and fixed value data (not shown) to be referred to by the CPU 11 when the control program 12*a* is executed. Each of the processes shown in the flow charts in FIG. 4 and FIG. 5 may be executed by the control program 12*a*.

The RAM 13 is a rewritable memory, and has a temporary storage area for temporarily storing various kinds of data for the CPU 11 to execute the control program 12*a*. The temporary area of the RAM 13 is provided with a L1 memory 13*a*, a L2 memory 13*b*, and a volume-up flag 13*c*.

The L1 memory 13*a* is a memory that stores a value of the level L1 that defines the current volume (current level) of a tone to be generated by the sound source 14. The L1 memory 13*a* is initialized (zeroed) when the electronic musical instrument 1 is powered on. When a value of the level L1 is set in a note event process (see FIG. 4) or a timer event process (see FIG. 5) to be described below, the set value of the level L1 is stored in the L1 memory 13*a*.

The L2 memory 13*b* is a memory that stores a value of the level L2 that defines a target volume (target level) of a tone to be generated by the sound source 14. The L2 memory 13*b* is initialized (zeroed) when the electronic musical instrument 1 is powered on. When the key 2*a* is depressed, a note-on is outputted from the keyboard 2, and each time the CPU 11 receives a note-on from the keyboard 2, a value of the level L2 set based on a velocity (volume information) included in the received note-on is stored in the L2 memory 13*b*.

The volume-up flag 13*c* is a flag that specifies whether the current volume (the level L1) of the tone to be generated by the sound source 14 is to be made greater or smaller. When the volume-up flag 13*c* is set to ON, a constant A is added to the value of the level L1 in the timer event process (see FIG. 5) described below to increase the volume (level) of the tone to be generated by the sound source 14. On the other hand, when the volume-up flag 13*c* is set to OFF, the constant A is subtracted from the value of the level L1 in the timer event process to decrease the volume of the tone to be generated by the sound source 14.

The volume-up flag 13*c* is initialized (set to OFF) when the electronic musical instrument 1 is powered on. Thereafter, when the key 2*a* is newly depressed in a state where there is a tone being generated, the volume-up flag 13*c* is set to a state according to the difference between the value of the level L2 based on the new key-depression and the magnitude of the value of the level L1 stored in the L1 memory 13*a*. More specifically, when the value of the level L2 is greater than the value of the level L1, the volume-up flag 13*c* is set to ON. On the other hand, when the value of the level L2 is smaller than the value of the level L1, the volume-up flag 13*c* is set to OFF.

Also, the temporary area of the RAM 13 is provided with a note-on map (not shown). The note-on map is a map that indicates whether or not a tone corresponding to each of the keys 2*a* is being generated. More specifically, the note-on map is composed of tone generation flags associated with notes (note numbers) corresponding to the respective keys 2*a*, and a region for storing a voice of the sound source 14 assigned to each of the notes. When a tone generation instruction is outputted to the sound source 14, a tone generation flag of a note corresponding to the tone generation instruction is set to ON, and information indicative of an assigned voice is stored. On the other hand, when a silencing instruction is outputted to the sound source 14, a tone generation flag of a note corresponding to the silencing instruction is set to OFF, and information indicative of the corresponding voice is erased.

The sound source 14 generates (emanates) tones with a tone color set by the performer at pitches corresponding to those of the keys 2*a* depressed or stops tones that are being generated, based on tone generation instructions or silencing instructions received from the CPU 11, respectively. The sound source 14 may have 128 tone generation channels (not shown), and is configured to be capable of generating multiple tones (voices). Upon receiving a tone generation instruction from the CPU 11, the sound source 14 generates a tone (an audio signal) with a pitch, a volume and a tone color according to the tone generation instruction through a voice assigned to the tone generation instruction. The voice may be composed of a single or a plurality of tone generation channels.

Figure 3:
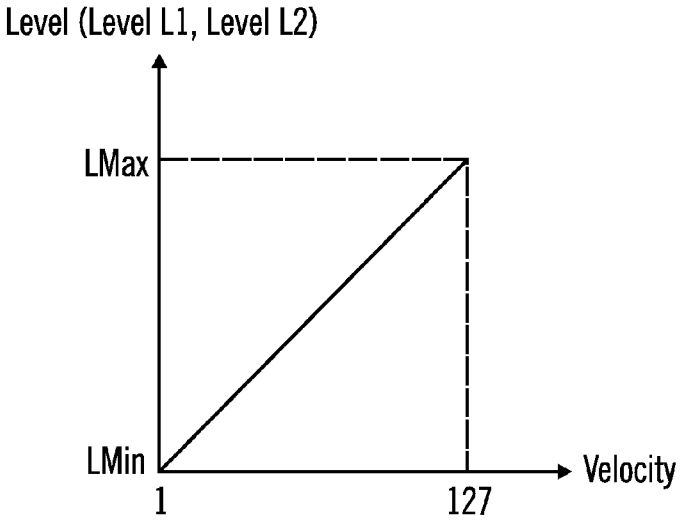
FIG. 3 is a graph providing a relation of volume level and velocity of the received note.

FIG. 3 illustrates an embodiment of a relation between the velocity and the level (the level L1 or the level L2). FIG. 3 is a graph for describing contents of a conversion table. The conversion table shown in FIG. 3 is a table that specifies the relation between the velocity and the level, and is stored in the ROM 12.

In FIG. 3, the horizontal axis shows velocities according to the MIDI standard. It is noted that values of the velocity can be 1 through 127. On the other hand, the vertical axis shows levels (levels L1 or levels L2). The level may be in the range between a minimum value Lmix and a maximum value Lmax. It is noted that the minimum value Lmix is a predetermined value greater than 0.

FIG. 3 provides an embodiment of a conversion table having a linearly proportional relation between the velocity and the level. In a note event process (see FIG. 4), a value of the level L2, which is to be set when the key 2*a* is newly depressed, is set by referring to a conversion table, such as FIG. 3, based on the value of the velocity included in the note-on received from the keyboard 2. On the other hand, a value of the velocity required for instructing the level of a tone based on the new key-depression to the sound source 14 is set by referring to the conversion table based on the value of the level L1 stored in the L1 memory 13*a*.

In the example shown in FIG. 3, the level (the level L1 or the level L2) has a linearly increasing relation with respect to increase in the velocity. However, the velocity and the level are not limited to a linearly increasing relation, but may have a logarithmically increasing relation (a convex upward monotonically increasing relation or a convex downward monotonically increasing relation) or the like.

Figure 4:
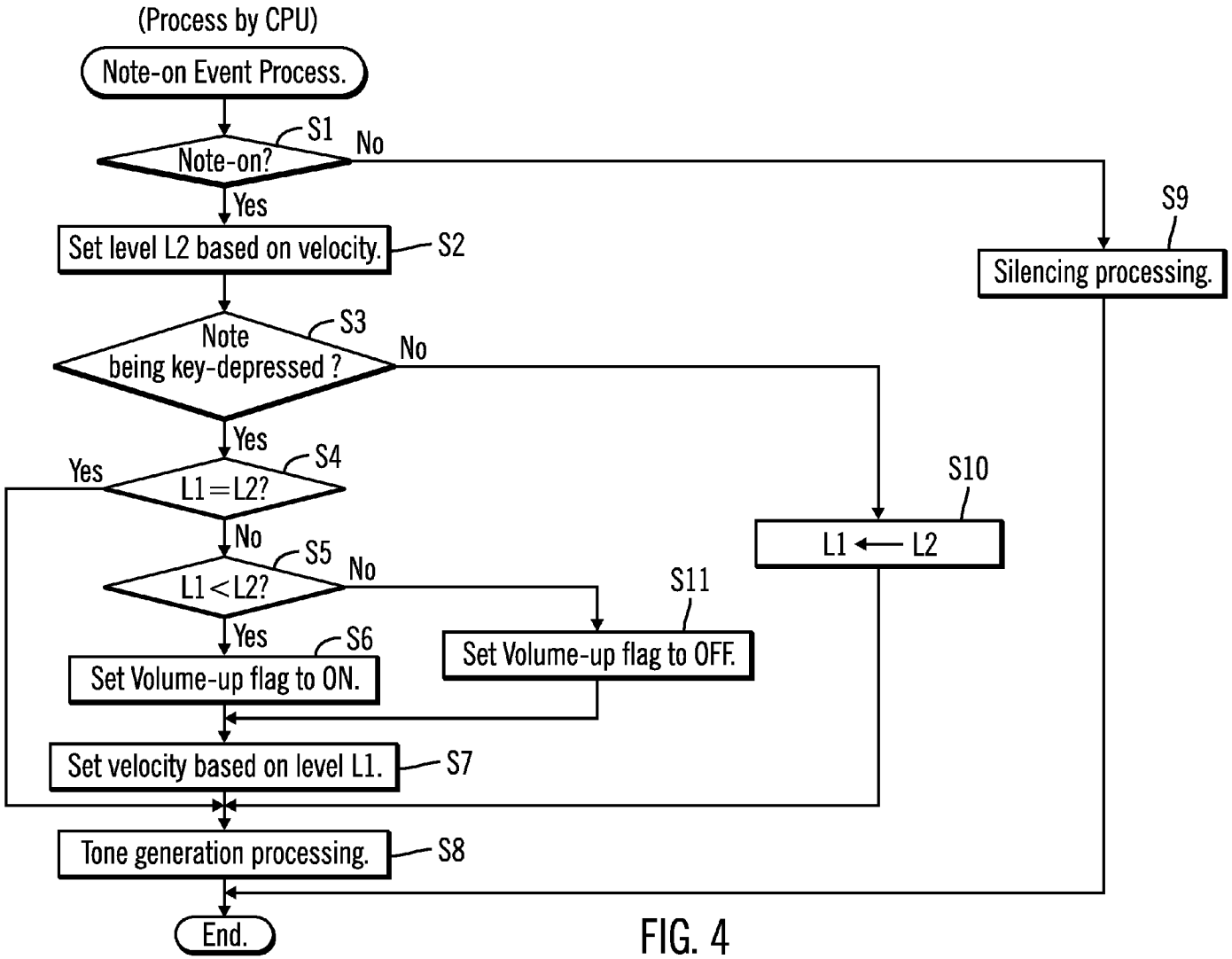
FIG. 4 is a flow chart showing a note event process executed by the electronic musical instrument.

FIG. 4 provides a process executed by the CPU 11 of the electronic musical instrument 1 in accordance with embodiments. FIG. 4 is a flow chart of a note event process executed by the CPU 11. The note event process is executed each time the CPU 11 receives a note event (a note-on or a note-off) from the keyboard 2, when the tone color of an accordion is set.

As shown in FIG. 4, in the note event process, first, it is judged as to whether or not a note event received from the keyboard 2 is a note-on (S1). When it is judged in S1 that the note event received is a note-on (S1: Yes), the level L2 is set based on a velocity included in the received note-on (S2). More specifically, the conversion table (see FIG. 3) is referenced based on the velocity included in the received note-on, and the value of the level L2 is set to the referenced value. The set value of the level L2 is stored in the L2 memory 13*b*.

After the processing in S2, it is judged as to whether or not any notes are being key-depressed (S3). If it is judged that no note is being key-depressed (S3: No), a tone will be generated independently based on the new key-depression, and therefore the value of the level L1 is set to the level L2 (S10). The set value of the level L1 is stored in the L1 memory 13*a*.

After the processing in S10, a tone generation processing is executed (S8), and the note event process is completed. In the tone generation processing (S8), a tone generation instruction according to a note number included in the received note-on (a pitch of the note newly key-depressed) and a velocity included in the received note-on is assigned to an empty one of the voices in the sound source 14 and outputted. Further, the tone generation flag corresponding to the newly key-depressed note in the note-on map (not shown) in the RAM 13 is set to ON, and information indicative of the assigned voice is stored.

Therefore, when the key 2*a* is newly key-depressed in a state where no note is key-depressed, a tone based on the new key-depression is generated at a pitch corresponding to the note number included in the received note-on, with a level based on the velocity included in the received note-on (i.e., a level specified by the value of the level L2).

On the other hand, if it is judged in S3 that there are notes being key-depressed, in other words, there are notes being generated (S3: Yes), it is judged as to whether or not the value of the level L2 set in S2 is equal to the value of the level L1 stored in the L1 memory 13*a* (S4). When it is judged in S4 that the value of the level L2 is equal to the value of the level L1 (S4: Yes), the process proceeds to the tone generation processing (S8). In this case also, like the case where a new key-depression independently occurs (in other words, when the judgment result is No in S3), a tone generation instruction according to a note number included in the received note-on and a velocity included in the received note-on is assigned to an empty one of the voices in the sound source 14 and outputted. In this way, a tone based on the new key-depression is generated with a pitch corresponding to the note number included in the received note-on, and with a level based on the velocity included in the received note-on.

In other words, when there is a note being generated and the level of the note based on the velocity included in the received note-on is equal to the level of the tone being generated, the level of the tone based on the new key-depression is set to be equal to the level defined by the value of the level L2 (the level according to the velocity of the new key-depression), in a manner similar to the case where a new key-depression occurs independently.

When it is judged in S4 that the value of the level L2 is different from the value of the level L1 (S4: No), it is judged as to whether or not the value of the level L2 is greater than the value of the level L1 (S5). When it is judged in S5 that the value of the L2 is greater than the value of the level L1 (S5: Yes), the volume-up flag 13*c* is set to ON (S6). On the other hand, when it is judged in S5 that the value of the L2 is smaller than the value of the level L1 (S5: No), the volume-up flag 13*c* is set to OFF (S11).

After the processing in S6 or S11, the process proceeds to S7, where a velocity based on the set value of the level L1 is set (S7). More specifically, a velocity is set by referring to the conversion table (see FIG. 3) based on the set value of the level L1.

After the processing in S7, the process proceeds to the tone generation processing (S8). In this case, there is a note being generated, and the level of the tone based on the velocity included in the received note-on is different from the level of the tone being generated. Therefore, in the tone generation processing (S8), a tone generation instruction according to the note number included in the received note-on (the pitch of the note of the newly depressed key) and the velocity set in S7 is assigned to an empty one of the voices in the sound source 14 and outputted.

Figure 5:
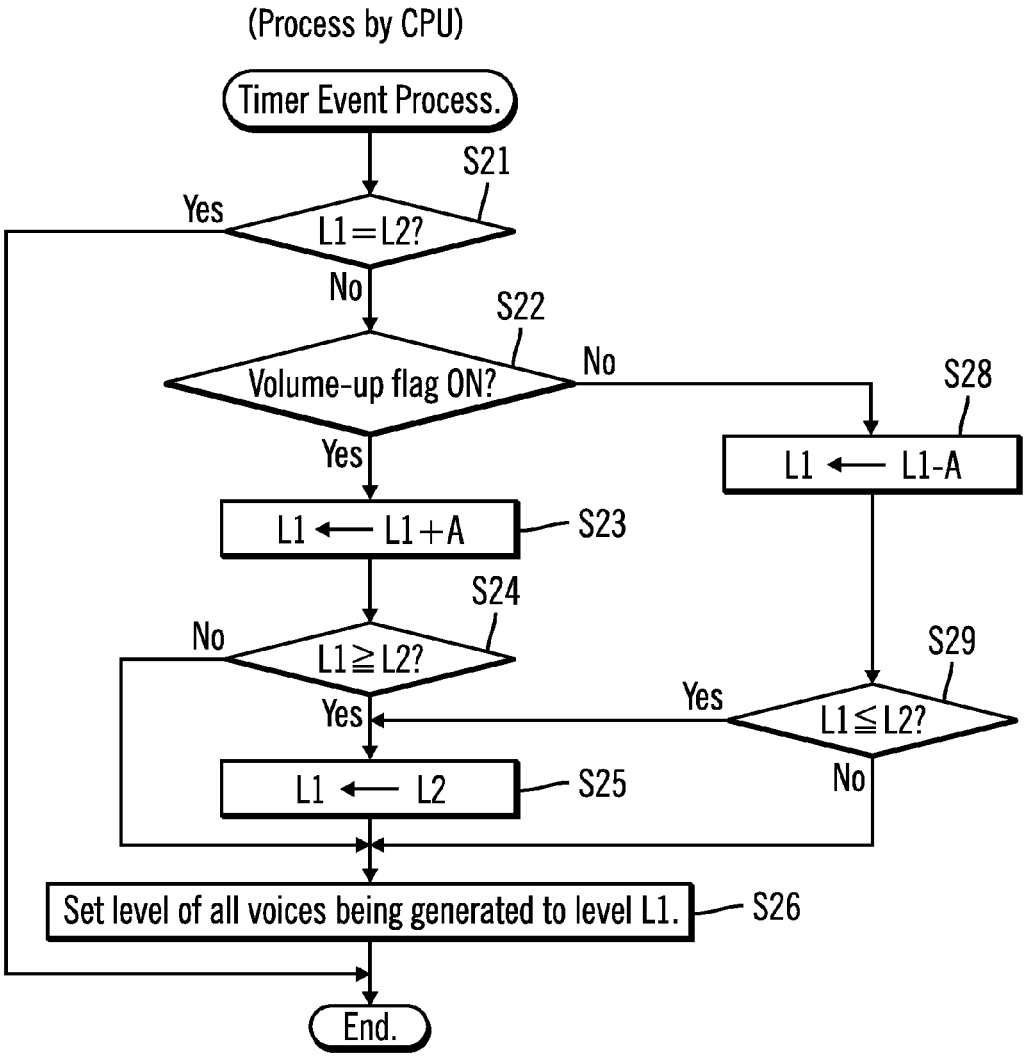
FIG. 5 is a flow chart showing a timer event process executed by the electronic musical instrument.

When the value of the level L1 and the value of the level L2 are different from each other, the value of the level L1 may be set in a timer event process (see FIG. 5). Details of the timer event process are described below. Therefore, when there is a note being generated, and the level of the tone based on the velocity included in the received note-on is different from the level of the tone being generated, a tone based on the new key-depression is generated with a pitch corresponding to the note number included in the received note-on, and with a level set in the timer event process.

Also, when it is judged in S1 that the received note event is a note-off (S1: No), a silencing process according to the received note-off is executed (S9). More specifically, a silencing instruction according to the note-off received is outputted to the corresponding voice by referring to the note-on map (not shown) in the RAM 13 to silence the tone corresponding to the note of the key that has been key-released.

FIG. 5 is a flow chart showing a timer event process executed by the CPU 11. The timer event process is started when the tone color that requires the execution of the note event process described above in FIG. 4 is set, by an interrupt processing taking place every 10 milliseconds (msec). The timer event process first judges as to whether or not the value of the level L1 stored in the L1 memory 13*a* is equal to the value of the level L2 stored in the L2 memory 13*b* (S21). When it is judged in S21 that the value of the level L1 equals to the value of the level L2 (S21: Yes), the timer event process is ended.

On the other hand, when it is judged in S21 that the value of the level L1 is different from the value of the level L2 (S21: No), it is judged as to whether or not the volume-up flag 13*c* is ON (S22). When it is judged in S22 that the volume-up flag 13*c* is ON (S22: Yes), the level L1 is set to a value obtained by adding a constant A to the value of the current level L1 (S23). The value of the level L1 set in S23 is stored in the L1 memory 13*a*.

After the processing in S23, it is judged as to whether or not the value of the level L1 set in S23 is equal to the value of the level L2 or greater stored in the L2 memory 13*b* (S24). When it is judged in S24 that the value of the level L1 is smaller than the value of the level L2 (S24: No), the process proceeds to S26.

On the other hand, when it is judged in S24 that the value of the level L1 is equal to the value of the level L2 or greater (S24: Yes), it means that the level of the tone generated by the sound source 14 (i.e., the level L1) has reached the target level set based on the velocity of the latest key-depression (i.e., the level L2). Accordingly, the value of the level L1 is set to the level L2 (S25), and the process proceeds to S26. It is noted that the value of the level L1 set in S25 is stored in the L1 memory 13*a*.

Also, when it is judged in S22 that the volume-up flag 13*c* is OFF (S22: No), the level L1 is set to a value obtained by subtracting the constant A from the current value of the level L1 (S28). The value of the level L1 set in S28 is stored in the L1 memory 13*a*.

After the processing in S28, it is judged as to whether or not the value of the level L1 set in S28 is equal to the value of the level L2 or less stored in the L2 memory 13*b* (S29). When it is judged in S29 that the value of the level L1 is greater than the value of the level L2 (S29: No), the process proceeds to S26.

On the other hand, when it is judged in S29 that the value of the level L1 is equal to the value of the level L2 or less (S29: Yes), the process proceeds to S25. Specifically, as the level of the tone generated by the sound source 14 (i.e., the level L1) has reached the target level set based on the velocity of the latest key-depression (i.e., the level L2), the value of the level L1 is set to the value of the level L2.

In S26, the level of all of the voices that are being generated is set to the value of the level L1 stored in the L1 memory 13*a* (S26). After the processing in S26, the timer event process is ended. By the processing in S26, the level of the tones being generated is changed to the level specified by the level L1. On the other hand, in the note event process described above (see FIG. 4), the level of a tone based on a new key-depression is also set to the level specified by the level L1. Accordingly, when there is already a tone being generated when the key 2*a* is newly key-depressed, the tone based on the new key-depression and the tone being generated will be generated at the same level specified by the level L1.

According to the timer event process described above, when a tone is already being generated when the key 2*a* is newly depressed, and the level of the tone being generated is different from the level of the tone based on the velocity of the new key-depression, the processing in S26 is executed. Accordingly, the level of the tone being generated is increased or decreased by the constant A according to the setting of the volume-up flag 13*c*. As the timer event process of the present embodiment is started up (executed) every 10 milliseconds (msec), the level of the tone being generated is increased or decreased by the constant A every 10 msec while the level of the tone being generated is different from the level based on the velocity of the new key-depression.

In other words, according to the timer event process, when a tone is already being generated when the key 2*a* is newly depressed, and the level of the tone being generated is different from the level of the tone based on the velocity of the new key-depression, the level of the tone being generated is gradually changed (increased or decreased) toward the target level. Here, the target level is the level based on the velocity of the new key-depression. In other words, the level of the tone being generated can be made to follow the level based on the velocity of the new key-depression. By this, performance characteristic of an accordion, which is a musical instrument in which the volume is controlled according to movements of the bellows, can be imitated by the electronic musical instrument 1.

Therefore, according to the electronic musical instrument 1 provided with the tone control device in accordance with the described embodiments, by merely changing the velocity of each of key-depressions, performance characteristic to an accordion can be imitated. In other words, by merely changing the key-depression strength (or key-depression speed) on a key-depression, the performer can imitate performance of a musical instrument in which the level is controlled according to movements of a bellows, such as, an accordion. Therefore, performance of such a musical instrument can be readily imitated without requiring the performer to make full use of the user interfaces, such as, an expression pedal, a volume pedal and the like.

Also, the level of a tone to be generated based on a new key-depression may not be the level based on the velocity of the new key-depression (in other words, the level specified by the value of the level L2), but may be the level specified by the value of the level L1 set in the timer event process described in FIG. 5, so that the tone generation is started at the same level as that of the tone being generated. Thereafter, the level of the tone based on the new key-depression is gradually increased or decreased toward the level specified by the value of the level L2 (in other words, the target level). Therefore, the tone based on the new key-depression and the tones being generated are not generated at different levels, and the level of the tone being generated is not suddenly changed to the target level (in other words, the level based on the velocity of the new key-depression). Accordingly, volume changes according to movements of a bellows (pressure changes inside a bellows) can be imitated by the level change described above without causing physical uneasiness.

Also, according to the electronic musical instrument 1 provided with the tone control device of described embodiments, when the level of a tone being generated is made to follow the level based on the velocity of a new key-depression (the target level), the level of the tone being generated, in other words, the level specified by the value of the level L1 is changed at a constant rate (a rate of the constant A every 10 msec). Therefore, the greater the difference between the level of a tone being generated and the target level, the longer it takes to reach the target level, whereby imitation of performance characteristic to an accordion-like musical instrument can be realized by relatively easy control.

Although the invention has been described above with respect to various embodiments, the invention is not limited to the described embodiments, and various modifications and improvements can be made within the range that does not depart from the subject matter of the invention.

For instance, in the above described embodiments, the CPU 11 executes the processes shown in FIG. 4 and FIG. 5 to achieve a configuration that can readily and sufficiently imitate performance of a musical instrument in which the level is controlled according to movements of a bellows, such as, an accordion. However, in alternative embodiments, the process shown in FIG. 4 may be executed by the sound source 14. Also, the CPU 11 may set the target level L2 based on the velocity of a new key-depression, and outputs the set target level L2 to the sound source 14, and interpolation from the current level L1 to the target level L2 may be executed by the sound source 14. In such alternative embodiments, the sound source 14 may execute a processing similar to the processing in S23 or S28 in the timer event process (see FIG. 5) described above, and execute an interpolation for the level of the tone toward the target level L2 set by the CPU 11.

In the described embodiments, the processes shown in FIG. 4 and FIG. 5 are executed when the tone color of an accordion is set. However, the processes shown in FIG. 4 and FIG. 5 are not limited to an accordion, but may be similarly applicable to the tone color of another musical instrument in which the level is controlled according to movements of a bellows (for example, a bandoneon). Further, the processes shown in FIG. 4 and FIG. 5 are not limited to the tone color of a musical instrument in which the level is controlled according to movements of a bellows, and may be applicable to other tone colors of any other musical instruments (for example, the tone color of any one of various musical instruments, such as, an organ, a wind instrument, etc.).

In the embodiments described above, the sound source 14 uses a sound source that changes the level (volume) of a tone to be generated according to the value of a velocity included in a tone generation instruction. However, in alternative embodiments, the sound source 14 may use a sound source in which the level of a tone to be generated does not depend on the value of a velocity. In this case, instead of the processing in S7 in the note event process in FIG. 4, level control information for controlling the level to be generated from the sound source may be set based on the value of the level L1; and in the tone generation processing (S8), the level of a tone to be generated by the sound source may be controlled based on the set level control information.

In the embodiments described above, the value of the level L1 is changed at a constant rate of the constant A every 10 msec. However, in alternative embodiments, the level change is not limited to changes at a constant rate. For example, at each passage of 10 milliseconds (msec), the value to be added or the value to be subtracted may be gradually made greater, or at each passage of 10 msec, the value to be added or the value to be subtracted may be gradually made smaller. Alternatively, for example, the time to reach the target level may be decided in a manner that, the greater the difference between the level of a tone being generated and the target level, the longer the time to reach the target level, and then during the period until the target level is reached, the value of the level L1 may be changed in a predetermined changing mode. The predetermined changing mode may be, for example, a mode in which the change in the level L1 at each predetermined time interval is constant (in other words, the change rate is constant), a mode in which the change rate differs according to the passage of time (for example, a mode in which the amount of increase in the level increases with the passage of time), and the like. Alternatively, regardless of the difference between the level of a tone being generated and the target level, the time to reach the target level may be set constant, and the level specified by the value of the level L1 may be changed.

In the embodiments described above, the value of the level L1 is changed at a predetermined timing (specifically, every 10 milliseconds (msec)). However, the timing to update the tone level being generated is not limited to periodic changes. For example, the level of a tone being generated may be changed at a timing that changes by a predetermined level based on a predetermined function that increases the level with the passage of time.

Also, the note event process described above (see FIG. 4) is configured such that, when a new key-depression is independently performed (in other words, when the judgment result in S3 is No), the process proceeds to the tone generation processing (S8), and a tone generation instruction corresponding to the received note-on is outputted to the sound source 14. Further, when there is a note being generated, and the level of a tone based on the velocity included in the received note-on is equal to the level of the tone being generated (in other words, when the judgment made in S4 is Yes), the processing is similarly conducted. In alternative embodiments, even when the judgment made in S3 is No, or the judgment made in S4 is Yes, the velocity set based on the level L1 may be instructed to the sound source 14 as the level of a tone based on the new key-depression. More specifically, when the judgment made in S3 is No, the processing in S10 is executed, and then the process may be moved to S7 where the velocity is set based on the level L1. Similarly, when the judgment made in S4 is Yes, the process may be moved to S7.

In the note event process described above (see FIG. 4), when it is judged in S3 that there is a note being key-depressed, the processing (S4) is executed to judge as to whether or not the level of a tone based on the velocity included in the received note-on is equal to the level of the tone being generated. However, in certain embodiments, the processing in S4 may be omitted. In such case, when there is a note being generated and the level of a tone based on the velocity included in the received note-on is equal to the level of the tone being generated, the processing in S7 is executed, whereby the velocity set based on the level L1 (that is equal to the level L2) is instructed to the sound source 14 as the level of the tone based on the new key-depression.

Further, in the embodiments described above, the timer event process shown in FIG. 5 is started up by an interrupt processing that is executed every 10 milliseconds (msec). However, the startup interval of the timer event process is not limited to 10 msec, but may be at another value, such as, 5 msec, 15 msec, etc.

In the embodiments described above, the target level L2 is set according to the velocity of one new key-depression (see FIG. 4, at S2). Alternatively, the target level L2 may be set for latest multiple key-depressions, based on velocities of the respective multiple key-depressions (for example, based on a weighted average of the velocities). Such a configuration can prevent the target level L2 from abruptly changing from the current level L1. Alternatively, when multiple key-depressions take place in a predetermined time, the target level L2 may be set based on velocities of the respective multiple key-depressions (for example, based on an average value of the velocities). By such a configuration, it is possible to reduce influences caused by variations in velocity among multiple key-depressions when they are intended to be a chord.

The embodiments described above are configured such that the entire area of the keyboard 2 is defined as one part, a tone corresponding to each of the keys 2*a* composing the keyboard 2 is subject to processing, the presence or absence of a tone being generated is judged, the target level L2 based on the velocity of a new key-depression is set, and level control toward the target level L2 is executed. In further embodiments, tones of multiple parts may be generated from the keyboard 2. For example, the keyboard 2 may be divided into multiple parts to generate tones of the multiple parts. In such case, the tone generation process is performed for each of the multiple parts independently from one another. For each of the multiple parts of the keyboard, tones composing each of the parts may be subject to processing, the presence or absence of tones being generated may be judged, the target level L2 based on the velocity of a new key-depression may be set, and level control toward the target level L2 may be executed. By this, performance by multiple accordions can be imitated.

Alternatively, when tones of multiple parts are generated from the keyboard 2, tones composing the multiple parts are subject to processing, the presence or absence of tones being generated may be judged, the target level L2 based on the velocity of a new key-depression may be set, and level control toward the target level L2 may be executed. In this case, the target level L2 may be set at a value that is different for each of the parts. By this, performance of a melody part and a base part by one accordion can be imitated.

In the embodiments described above, the tone control device in accordance with the invention is mounted on the electronic musical instrument 1 constructed in one piece with the keyboard 2. In alternative embodiments, the tone control device may be configured to be mounted on a sound source module to which a keyboard, such as the keyboard 2, that outputs note-on and note-off signals can be detachably connected. Also, the tone control device may be configured independently from the sound source 14.

What is claimed is:

1. A tone control device in communication with a tone generation device that is capable of generating a plurality of tones and capable of generating or silencing a tone with a predetermined pitch, comprising:

an input device that inputs a tone generation instruction including pitch information and volume information and a silencing instruction including the pitch information;

a memory device;

a processor;

a control program that when executed by the processor performs operations, the operations comprising:

storing in the memory device a current level of a current tone being generated from the tone generation device;

receiving a new tone generation instruction from the input device while generating the current tone at the current level, wherein the new tone generation instruction indicates a new tone and a new tone level corresponding to volume information at which to generate the new tone;

setting a target level in the memory device based on the tone level in the new tone generation instruction;

instructing the tone generation device to generate the new tone at the current level stored in the memory device while the current tone is being generated by the tone generation device; and instructing the tone generation device to gradually change the tone level of all tones that are being generated by the tone generation device from the current level at which all the tones are being generated, including the current tone and the new tone, toward the target level while all the tones are being generated.

2. The tone control device of claim 1, wherein the tone generation device is instructed to generate the new tone at the target level in response to receiving the new tone generation instruction when there is no tone that is being generated by the tone generation device.

3. The tone control device of claim 1, wherein the operations further comprising:

setting a changed level to gradually change the level of the tone that is being generated from the tone generation device from the current level to the target level;

instructing the tone generation device to generate the new tone at the changed level, to change the level of the tone that is being generated to the changed level, and thereafter to change the level of all tones that are being generated by the tone generation device to the changed level.

4. A method, comprising:

receiving a note-on event associated with a received volume level from an input device;

storing the received volume level in a memory device;

processing a current volume level indicated in the memory device to determine a new volume level in response to receiving the note-on event while generating at least one current tone at the current volume level;

generating the at least one current tone and a new tone associated with the received note-on event at the current volume level; and gradually changing the volume level at which the at least one current tone and the new tone are being generated from the current volume level to the new volume level while generating the at least one current tone and the new tone.

5. The method of claim 4, further comprising:

setting a target volume level in the memory device to the received volume level, wherein the current volume level and the target volume level are processed to determine the new volume level.

6. The method of claim 5, wherein the input device comprises an electronic keyboard divided into a plurality of parts, wherein the operations of receiving the note-on event, setting the target volume level, processing the current volume level, and generating the at least one current tone and the new tone are performed independently with respect to note-on events received from different of the plurality of parts of the electronic keyboard, and wherein the tones generated from note-on events from the different parts are capable of being generated at different target volume levels.

7. The method of claim 5, further comprising:

receiving a plurality of note-on events having a plurality of received volume levels, wherein the target volume level is set to a function of the received volume levels.

8. The method of claim 4, further comprising:

periodically adjusting the current volume level towards the received volume level after generating the at least one current tone and the new tone at the new volume level; and generating the at least one current tone and the new tone at the adjusted current volume level.

9. The method of claim 8, wherein the current volume is adjusted at a constant predetermined time interval or at a time interval that changes over time and wherein an adjustment amount by which the current volume level is adjusted is constant or variable.

10. The method of claim 8, further comprising:

determining whether the current volume level when the note-on event is received is less than or greater than the received volume level, wherein the periodically adjusting the current volume level towards the received volume level comprises:

incrementing the current volume level in response to determining that current volume level when the note-on event was received was less than the received volume level; and decrementing the current volume level in response to determining that the current volume level when the note-on event was received was greater than the received volume level.

11. The method of claim 4, further comprising:

generating the new tone at the received volume level in response to determining that no notes are being generated when receiving the note-on event or in response to the current volume level equaling the received volume level.

12. A tone control device coupled to an electronic musical instrument input device and a sound source, comprising:

a processor; and a computer readable storage device including a control program executed by the processor to perform operations, the operations comprising:

receiving a note-on event associated with a received volume level from the input device;

processing a current volume level to determine a new volume level in response to receiving the note-on event while generating at least one current tone at the current volume level;

generating the at least one current tone and a new tone associated with the received note-on event at the current volume level; and gradually changing the volume level at which the at least one current tone and the new tone are being generated from the current volume level to the new volume level while generating the at least one current tone and the new tone.

13. The tone control device of claim 12, wherein the operations further comprise:

setting a target volume level to the received volume level, wherein the current volume level and the target volume level are processed to determine the new volume level.

14. The tone control device of claim 13, wherein the input device comprises an electronic keyboard divided into a plurality of parts, wherein the operations of receiving the note-on event, setting the target volume level, processing the current volume level, and generating the at least one current tone and the new tone are performed independently with respect to note-on events received from different of the plurality of parts of the electronic keyboard, and wherein the tones generated from note-on events from the different parts are capable of being generated at different target volume levels.

15. The tone control device of claim 13, wherein the operations further comprise:

receiving a plurality of note-on events having a plurality of received volume levels, wherein the target volume level is set to a function of the received volume levels.

16. The tone control device of claim 12, wherein the operations further comprise:

periodically adjusting the current volume level towards the received volume level after generating the at least one current tone and the new tone at the new volume level; and generating the at least one current tone and the new tone at the adjusted current volume level.

17. The tone control device of claim 16, wherein the current volume is adjusted at a constant predetermined time interval or at a time interval that changes over time and wherein an adjustment amount by which the current volume level is adjusted is constant or variable.

18. The tone control device of claim 16, wherein the operations further comprise:

determining whether the current volume level when the note-on event is received is less than or greater than the received volume level, wherein the periodically adjusting the current volume level towards the received volume level comprises:

incrementing the current volume level in response to determining that current volume level when the note-on event was received was less than the received volume level; and decrementing the current volume level in response to determining that the current volume level when the note-on event was received was greater than the received volume level.

19. The tone control device of claim 12, wherein the operations further comprise:

generating the new tone at the received volume level in response to determining that no notes are being generated when receiving the note-on event or in response to the current volume level equaling the received volume level.

20. The tone control device of claim 1, wherein the generating all the tones while gradually changing the tone level results in imitation of an accordion like musical instrument.

21. The method of claim 4, wherein the generating all the tones while gradually changing the volume level results in imitation of an accordion like musical instrument.

22. The tone control device of claim 12, wherein the generating all the tones while gradually changing the volume level results in imitation of an accordion like musical instrument.

23. The tone control device of claim 1, wherein the generating all the tones while gradually changing the tone level results in sound produced by a musical instrument in which the level of tones is controlled according to movement of a bellows.

24. The method of claim 4, wherein the generating all the tones while gradually changing the volume level results in sound produced by a musical instrument in which the level of tones is controlled according to movement of a bellows.

25. The tone control device of claim 12, wherein the generating all the tones while gradually changing the volume level results in sound produced by a musical instrument in which the level of tones is controlled according to movement of a bellows.

* * * * *